United States Patent [19]

Bernstein

[11] Patent Number: 4,972,886

[45] Date of Patent: Nov. 27, 1990

[54] ICE DISTRIBUTION SYSTEM

[76] Inventor: David T. Bernstein, 1089 Oakland Trace, Atlanta, Ga. 30319

[21] Appl. No.: 432,597

[22] Filed: Nov. 6, 1989

Related U.S. Application Data

[63] Continuation-in-part of Ser. No. 187,043, Apr. 22, 1988, abandoned.

[51] Int. Cl.[5] ..... B65B 1/04; B65B 3/04

[52] U.S. Cl. ..... 141/98; 141/237; 141/106; 141/240; 141/365; 141/364

[58] Field of Search ..... 209/615, 682, 706, 236, 209/352, 259; 141/100, 102–104, 234, 237–247, 363–366, 98

[56] References Cited

U.S. PATENT DOCUMENTS

| | | | |
|---|---|---|---|
| 1,139,269 | 5/1915 | Goodman | 222/429 |
| 1,790,626 | 1/1971 | Menniger et al. | 141/237 X |
| 2,447,281 | 8/1948 | Schneir | 141/237 |
| 2,720,351 | 10/1955 | Fleischer et al. | 141/246 |
| 3,181,739 | 5/1965 | Dye | 222/158 |
| 3,566,929 | 3/1971 | Mead | 141/237 |
| 3,693,673 | 9/1972 | Oates | 141/237 |
| 3,732,903 | 5/1973 | Oates | 141/237 |
| 3,893,494 | 7/1975 | Whitney | 141/244 |
| 3,987,824 | 10/1986 | Zehnder | 141/99 |
| 4,184,523 | 1/1980 | Carrigan et al. | 141/238 |
| 4,800,934 | 1/1989 | Boissoneault | 141/106 |

FOREIGN PATENT DOCUMENTS

| | | | |
|---|---|---|---|
| 2453076 | 12/1980 | France | 141/237 |

*Primary Examiner*—Ernest G. Cusick

[57] ABSTRACT

An ice distribution system comprises a light weight, hand carried ice distribution tray which functions in conjunction with a plurality of glasses, or other drink receptacles, removably retained by a base assembly, or industry standard dishwashing rack, or both to provide a quick easy system for distributing ice, or fluent drinking matter, or both to the plurality of drink receptacles; and the ice distribution tray thereof is formed with a plurality of apertures formed through the bottom of the tray, which plurality of apertures are arranged in a predefined pattern to match the pattern which the plurality of drink receptacles occupy on the base assembly, or industry standard dishwashing rack, or both, and is also formed with short protruding lip members extending from each of the plurality of apertures which maintain the plurality of apertures in alignment with the plurality of drink receptacles during the process of filling the plurality of drink receptacles with ice, or fluent drinking matter, or both.

12 Claims, 6 Drawing Sheets

ICE DISTRIBUTION SYSTEM

STATEMENT

This application is a continuation in part of application Ser. No. 187,043, filed Apr. 22, 1988, abandoned.

FIELD OF THE INVENTION:

This invention relates generally to the field of food service equipment and, more specifically, to equipment utilized in the distribution of ice, or fluent drinking matter, or both and the servicing of drink receptacles.

BACKGROUND OF THE INVENTION:

Restaurants and group dining facilities provide in the course of an evening a very large number of glasses of iced water or other iced drinks. There have long been recognized problems with the typical methods utilized to distribute ice, or fluent drink matter, or both to the large volume of glasses. Thus, inventors have sought over the years to alleviate some of these problems. A good example of some problems sought to be addressed by these inventors is clearly described in the specification of U.S. Pat. #3,987,824: "In most restaurants, empty glasses are stocked at a serving station which has an ice cube bin and a water distributing nozzle and the glasses are filled individually by the waiters or waitresses as needed. While this system in general is satisfactory for low volume operations, it presents several problems in busier operations, particularly during peak periods. One obvious draw-back is that a certain amount of time is required to put ice cubes into a glass and then subsequently fill the glass with water. Where this task must be repeated for each individual glass to be filled, a substantial amount of busy waitress' time can be consumed. The second problem is one of sanitation in that, when pressed for time, the person filling the glass will frequently dip the glass into the ice cube bin, rather than using the ice cube scoop, thus brushing their hands through cubes in the bin." The above described problems in restaurants, as well as hotels, sports arenas, convention centers, and other public areas has as expressed above, been addressed by other inventors. Two known examples of the prior art solutions to these problems are seen in U.S. Pat. #3,181,739 and #3,987,824.

Also, in U.S. Pat. #3,566,929, Mead, the preferred use of cited patent requires a drink receptacle of specific proportion to facilitate proper function. It is the specific advantage of the invention herein disclosed to accommodate receptacles of all proportions and designs. Any drink receptacle which could be maintained in an industry standard dishwashing rack can be properly accessed by the embodiment of the invention disclosed herein.

As noted by studying the above cited patents, the prior art solutions to the ice distribution problem have jumped from the simplicity of the ice bin and scoop process to the complexity of rather cumbersome assemblies which are relatively expensive, have potentially troublesome working parts, consume counter space within the kitchen facility, and include numerous covered or otherwise hard to clean edges and parts.

SUMMARY OF THE INVENTION:

Briefly described, the present invention comprises a light-weight, hand carried ice distribution tray which functions in conjunction with a plurality of glasses, or other drink receptacles, removably retained on a base assembly, or an industry standard dishwashing rack, or both which provide a quick and easy system for distributing ice, fluent drinking matter, or both to the plurality of drink receptacles. The ice distribution tray is outfitted with a plurality of apertures formed through the bottom of the tray, which plurality of apertures are arranged in a pre-defined pattern to match the pattern which the plurality of drink receptacles occupy while removably retained on the base assembly, or industry standard dishwashing rack, or both. Ice distribution trays, in accordance with various embodiments of the present invention, are formed in various shapes and sizes and the plurality of apertures are arranged in various pre-defined patterns; but always, the size, shape, and pre-defined pattern of the particular embodiment cooperates with the base assembly's and industry standard dishwashing rack's shape and size, the plurality of drink receptacle's shape and size, and the pattern defined by the plurality of drink receptacles when stored in the base assembly and in the industry standard dishwashing rack. The ice distribution tray is also formed with short protruding lip members which maintain the plurality of apertures in alignment with the plurality of drink receptacle during the process of filling the plurality of drink receptacles with ice, fluent drinking matter, or both. The ice distribution tray is easily moved from one plurality of drink receptacles to another plurality of drink receptacles.

It is therefore an object of the present invention to provide an ice distribution system which provides for cooperation between a hand-carried aperture bearing tray and a plurality of drink receptacles a quick and easy process of distributing ice, fluent drinking matter, or both.

Another object of the present invention is to provide an ice distribution system by which a user can quickly move, with relatively little strain, from one plurality of drink receptacles to another plurality of drink receptacles, filling each plurality of drink receptacles with ice, fluent drinking matter, or both.

Still another object of the present invention is to provide an ice distribution system in which all components of the system can be washed and sanitized within a standard commercial sink or within a standard commercial dishwasher.

Another object of the present invention is to provide a light-weight hand carried ice distribution tray from which ice, fluent drinking matter, or both can be easily and quickly distributed to a plurality of drink receptacles.

Still other objects, features and advantages of the present invention will become apparent upon reading and understanding this specification, when taken in conjunction with the accompanying drawings.

Figure 1:
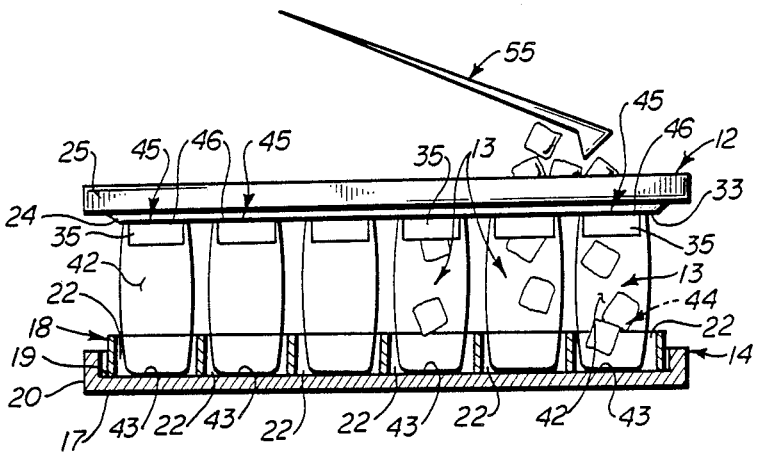
FIG. 1 is a side view of an ice distribution system in accordance with one embodiment of the present invention, showing the system in its ice distribution mode.
Figure 4:
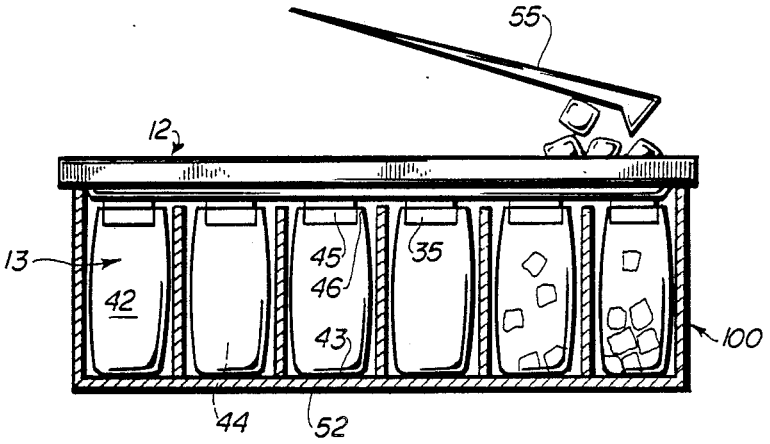
FIG. 4 is a side view of an ice distribution system in accordance with one embodiment of the present invention, showing the system in its ice distribution mode.

DETAILED DESCRIPTION OF THE PREFERRED EMBODIMENT:

Referring now in greater detail to the drawings in which like numerals represent like components throughout the several views, the ice distribution system's apparatus, FIGS. 1 and 4, are seen as comprising an ice distribution tray 12, and a plurality of drink receptacles (or other glasses) 13. Also, FIG. 1 is seen comprising a base assembly 14 and FIG. 4 is seen comprising an industry standard dishwashing rack 50. The base assembly 14 is a two stage assembly including a base tray 17 and a compartmentalized spacing member 18. The base tray 17 is seen in the preferred embodiment as having a substantially flat base plate 19 and a raised edge 20 thereabout. The spacing member 18 is segmented into a plurality of compartments 22 arranged in a pre-defined pattern. The compartmentalized spacing member 18 is a unit separate from the base tray 17 and removably rests on the base plate 19. In the disclosed embodiment of the drawings, the pre-defined pattern is what might be described as a six by six grid. The industry standard dishwashing rack 50 is segmented into a plurality of compartments 51 arranged in a pre-defined pattern. In the disclosed embodiment of the drawings, the pre-defined pattern is what might be described as a six by six grid. The industry standard dishwashing rack 50 also comprises at least a top surface 60 and a bottom surface 52.

Within each of the plurality of compartments 22 of the spacing member 18 and each of the plurality of compartments 51 of the industry standard dishwashing rack 50, a drink receptacle 13 of the plurality of drink receptacles 13 is removably retained. Each drink receptacle 13 of the plurality of drink receptacles 13 is seen as including, generally, a body portion 42 which defines a cavity 44 therein, a bottom 43, and a top edge 46 defining a mouth 45 accessing the cavity 44.

Figure 2:
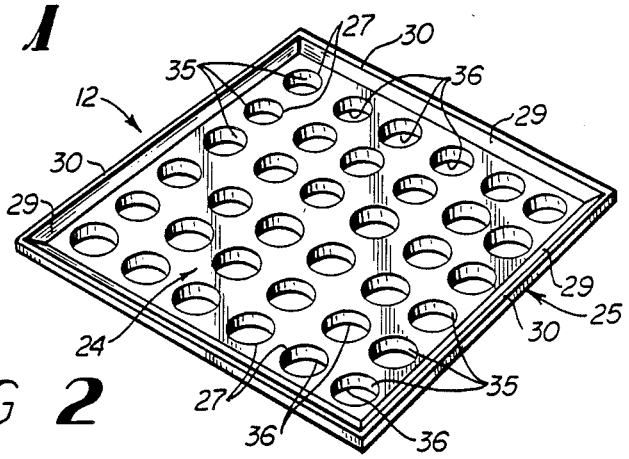
FIG. 2 is a pictorial view of an ice distribution tray as used in the ice distribution system of FIG. 1, showing one embodiment of the tray.
Figure 3:
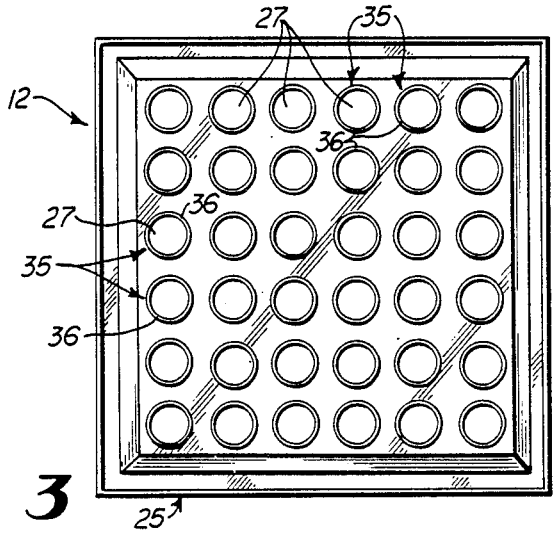
FIG. 3 is a bottom view of the ice distribution tray of FIG. 2.

With references to FIGS. 2 and 3, the ice distribution tray 12 is seen as comprising a bin plate 24 and side walls 25 which surround the bin plate 24. The plurality of apertures 27 are interspersed about the bin plate 24 in a pre-defined pattern which preferably matches the pre-defined patterns of the plurality of compartments 22 of spacing member 18 and the pre-defined pattern of the plurality of compartments 51 of industry standard dishwashing rack 50. As stated above, the pre-defined pattern of the embodiment disclosed in FIGS. 2 and 3 is a six-by-six grid configuration. It is understood that the scope of the present invention is not limited by the specifically disclosed pre-defined pattern of the plurality of apertures upon the ice distribution tray 12, nor by the exact configuration of the plurality of compartments 22 of the spacing member 18 or the exact configuration of the plurality of compartments 51 of dishwashing rack 50 as described herein.

With reference to FIG. 1, each of the plurality of apertures 27 is seen as being formed so as to define the lip portion 35 which extends below the lower surface 33 of the bin plate 24. In preferred embodiments, there is a bevelled bin wall 29 which slants downward and inward from the top edge 30 of the side walls 25 to the upper surface 32 of the bin plate 24.

The ice distribution tray 12 is seen in FIG. 1 as resting directly upon the plurality of drink receptacles 13 with the lower surface 33 of the bin plate 24 engaging the upper edges 46 of the plurality of drink receptacles 13. The lip portions 35 of the plurality of apertures 27 of the ice distribution tray 12 extend less than one quarter of the way into the cavities 44 of the plurality of drink receptacles 13, one lip portion 35 extending into one drink receptacle 13.

The ice distribution tray 12 is seen in FIG. 4 as resting directly upon the plurality of drink receptacles 13 and industry standard dishwashing rack 50 combination, with the lower surface 33 of the bin plate 24 engaging either the mouth portions 45 of the plurality of drink receptacles 13 or the top surface 60 of industry standard dishwashing rack 50; depending which ever of the plurality of drink receptacle's height or industry standard dishwashing rack's height is greater. The lip portions 35 of the plurality of apertures 27 of the ice distribution tray 12 extend less than one quarter of the way into the cavities 44 of the plurality of drink receptacles 13, one lip portion 35 extending into one drink receptacle 13.

Whereas other design choices are possible within the scope of the present invention, the specific embodiment disclosed in the accompanying drawn figures is seen as selecting a rectangular (square) base assembly 14 design, a rectangular (square) distribution tray 12 design, a rectangular (square) dishwashing rack 50, and a predefined pattern for the plurality of apertures 27 of a square six-by-six configuration. In preferred embodiments, the plurality of drink receptacles 13 are rigid or semi-rigid cups having round mouths 45 formed by circular upper edges 46. The plurality of apertures 27 of the ice distribution tray 12 are also circular; the lip portions 35 of the plurality of apertures 27 of this disclosed preferred embodiment being formed of annular rim segments 36 having outside diameters slightly less than the inside diameter of the mouth portions 45 of the plurality of drink receptacles 13.

Whereas the ice distribution tray 12 is alternately formed of various different materials, it is preferably formed of light weight molded plastic which is rigid, durable, machine washable, and acceptable by health standards for use in a public kitchen.

OPERATIONS

With the components of the ice distribution systems' apparatus, FIGS. 1 and 4, of the present invention described above, two methods of ice distribution in accordance with the preferred embodiment of the present invention are described below with reference to FIGS. 5A–5G and 6A–6F.

Figure 5A:
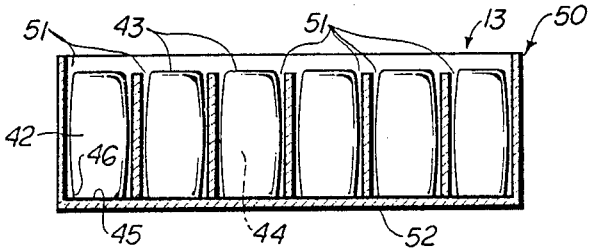
FIGS. 5A–5G are a sequential pictorial representation of glass preparation and ice distribution in accordance with a preferred embodiment of the present invention and a particular base assembly.
Figure 5B:
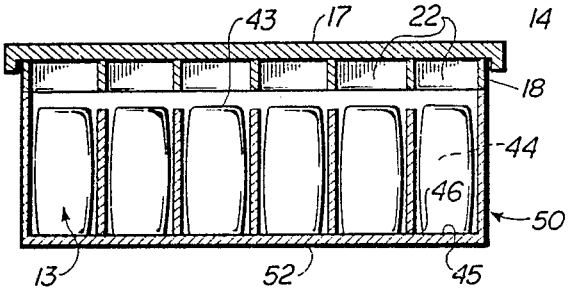
Figure 5C:
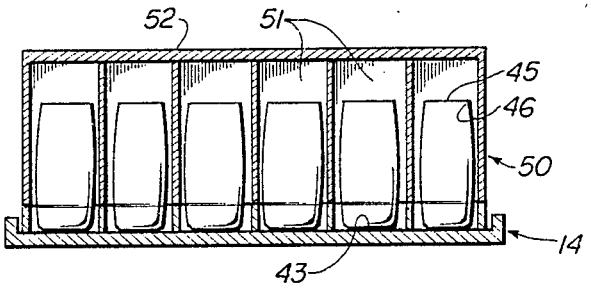
Figure 5D:
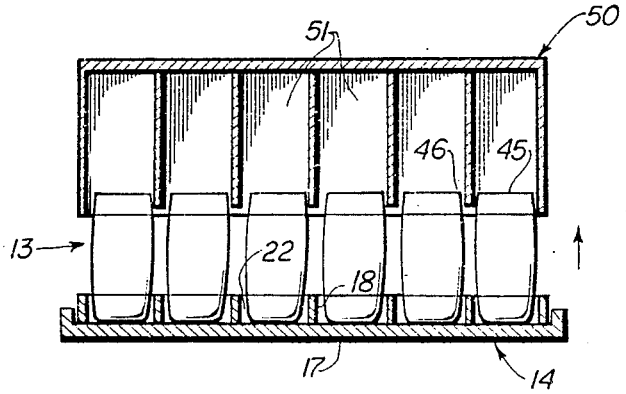
Figure 5E:
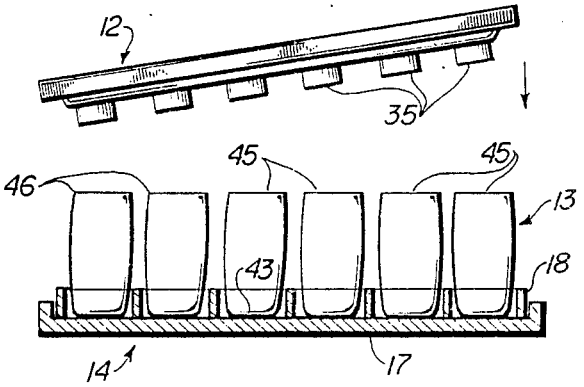
Figure 5F:
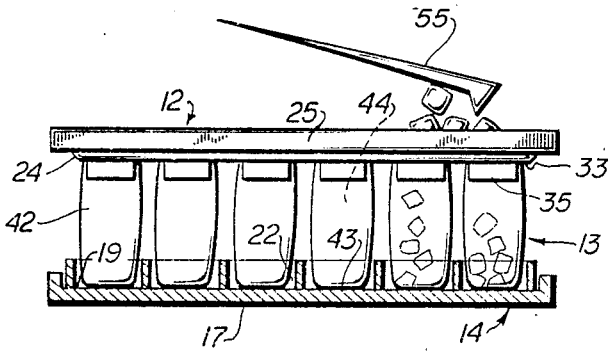
Figure 5G:
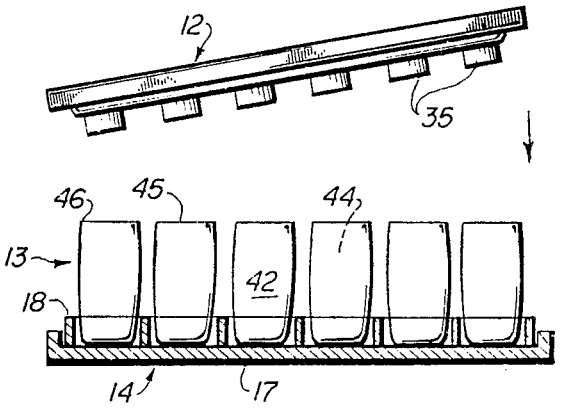

The first method is taken from the glass washing cycle FIG. 5A through glass preparation (FIGS. 5B–5D) to the ice distribution stage (FIGS. 5E–5G). With reference to FIG. 5A, a plurality of drink receptacles 13 are removed from the dishwashing machine (not shown) where they have been maintained in a plurality of compartments 51 of industry standard dishwashing rack 50 with bottom surface 52 and top surface 60. In the industry standard dishwashing rack 50, the plurality of drink receptacles 13 are maintained with their bottom sides 43 upward and their mouth portions 45 downward. At FIG. 5B, the compartmentalized spacing member 18 is placed on the top surface 60 of the industry standard dishwashing rack 50. The pre-defined pattern of compartments 22 of the spacing member 18 is pre-defined to match the pre-defined pattern of compartments 51 in the industry standard dishwashing rack 50. Thus, the spacing member 18 is situated on the top surface 60 of the industry standard dishwashing rack 50 with the compartments 22 of spacing member 18 in alignment with the compartments 51 of the industry standard dishwashing rack 50. The base tray 17 of the base assembly 14 is then placed upside-down (FIG. 5B) on top of the spacing member 18 such that the spacing member 18 is under the flat base plate 19 and within the raised edge 20 of base plate 19.

Whereas the base assembly 14 is seen in the embodiments herein disclosed as a two-piece assembly, it is within the scope of the present invention that the base assembly 14, in alternate embodiments, comprises a single unit of which the base tray 17 and the spacing member 18 are fixedly attached to one another. Furthermore, in less preferred yet acceptable alternate embodiments of the present invention, the base assembly 14 comprises simply the base tray 17, having no compartmentalized spacing member.

With the base assembly 14 on the top surface 60 of the industry standard dishwashing rack 50 as seen in FIG. 5B, the busboy or other user places one hand on the bottom (now top) of the base tray 17 and the other hand on the bottom surface 52 of the industry standard dishwashing rack 50. The user then "flips" the entire arrangement upside-down so that the base assembly 14 is on the bottom and the industry standard dishwashing rack 50 is on the top; as seen in FIG. 5C. The plurality of drink receptacles 13 are now oriented with their mouth portions 45 upward having slid down within the plurality of compartments 51 of industry standard dishwashing rack 50 with their bottom sides 43 retained within the plurality of compartments 22 of the spacing member 18 and resting on the base tray 17. With reference to FIG. 5D, the industry standard dishwashing rack 50 is now lifted off of the base assembly 14 so that the mouth portions 45 of the plurality of drink receptacles 13 are exposed. The ice distribution tray 12 is now placed on top of the plurality of drink receptacles 13 (FIG. 5E) with the ice distribution tray 12 resting directly on the upper edges 46 of the plurality of drink receptacles 13. Attention is now directed to FIG. 5F where the cooperating arrangement of the plurality of apertures 27 and lip portions 35 of the ice distribution tray 12, the mouth portions 45 and the cavities 44 of the plurality of drink receptacles 13, and the plurality of compartments 22 of spacing member 18 all cooperate in alignment. It is recalled that the pre-defined pattern of the plurality of apertures 27 of the ice distribution tray 12 have been pre-defined to match the plurality of compartment's 22 pattern of the spacing member 18 and thus the plurality of compartment's 51 pattern of the industry standard dishwashing rack 50.

With the ice distribution tray 12 now setting on the plurality of drink receptacles 13 (FIG. 5F), the lip portions 35 of the ice distribution tray 12, which extend less than one quarter of the way into the cavities 44 of the plurality of drink receptacles 13, provide the multiple functions of: (1) defining a direct passage for ice, fluent drinking matter, or both from the bin plate 24 of the ice distribution tray 12 into the cavities 44 of the plurality of drink receptacles 13, (2) aligning each of the plurality of drink receptacles 13 with each of the respective plurality of apertures 27 of ice distribution tray 12 and maintaining that alignment, and (3) maintaining the ice distribution tray 12 in position on top of the of plurality of drink receptacles 13 during the movement and distribution of ice, or fluent drinking matter, or both upon the bin plate 24.

With the ice distribution tray 12 now in position on top of the drink receptacles 13 as seen in FIG. 5F, ice, or fluent drinking matter, or both is scooped, poured, or otherwise placed onto the bin plate 24 where the bin plate 24 and the bevelled bin walls 29 form a bin to retain the ice, or fluent drinking matter, or both. The beveled bin walls 29 provide for smoother movement of the ice, or fluent drinking matter, or both upon the bin plate 24. The ice, or fluent drinking matter, or both is moved about upon the bin plate 24 by hand (providing proper sanitary conditions) or in alternate embodiments by use of a rake device 55. The ice, or fluent drinking matter, or both is pushed about so as to fall through the plurality of apertures 27 and into the plurality of drink receptacles 13. When all of the drink receptacles 13 are full or filled with ice, or fluent drinking matter, or both to the desired level, the ice distribution tray 12 is picked up off the plurality of drink receptacles 13 and moved to a second waiting base assembly 14; loaded with a second plurality of drink receptacles 13 configured with their mouth portion 45 upward, as in FIG. 5G, via the technique previously described.

Another method of use exists for the ice distribution tray 12. In accordance with the preferred embodiment of the present invention, this method is described below.

Figure 6A:
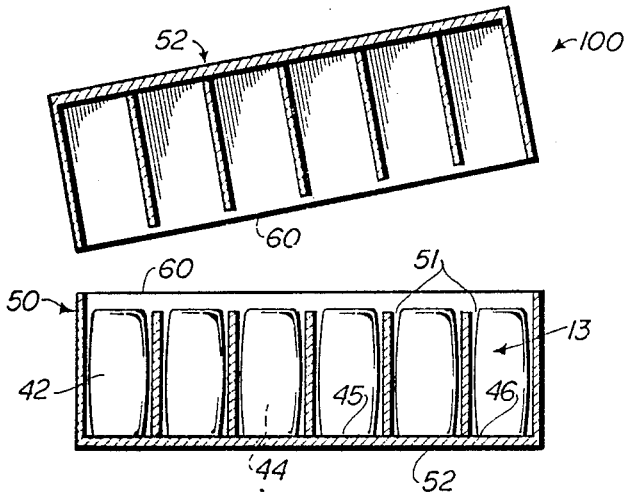
FIGS. 6A–6F are a sequential pictorial representation of glass preparation and ice distribution in accordance with a preferred embodiment of the present invention and a particular industry standard dishwashing rack.
Figure 6B:
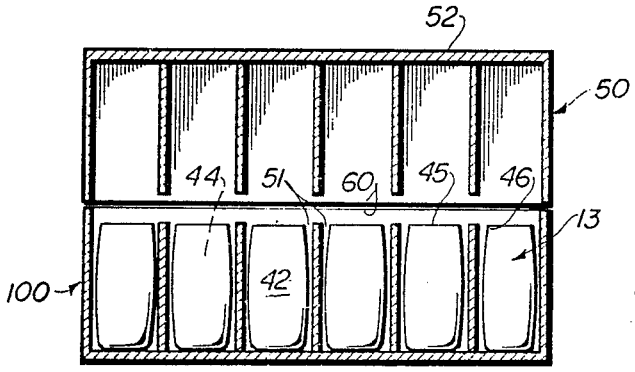
Figure 6C:
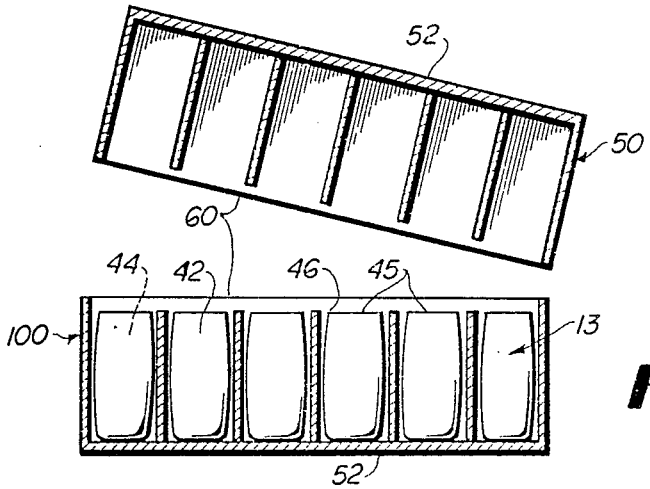
Figure 6D:
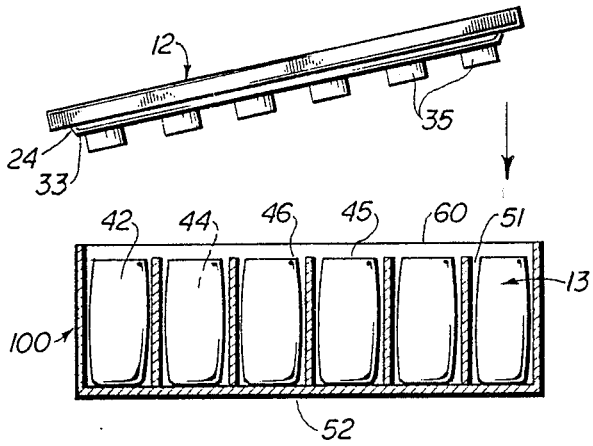
Figure 6E:
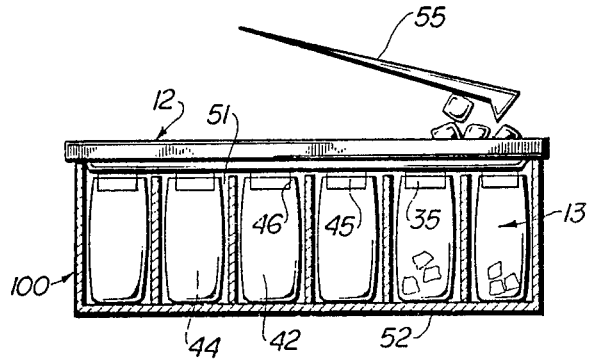
Figure 6F:
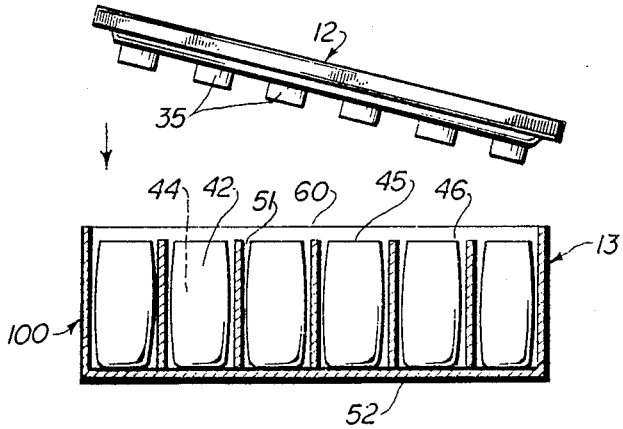

This method is taken from the glass washing cycle (as in FIG. 5A) through glass preparation stage (FIGS. 6A–6C) to the ice distribution stage (FIGS. 6D–6F). With reference to FIG. 5A, a plurality of drink receptacles 13 are removed from the commercial dishwasher (not shown) where they have been maintained in a plurality of compartments 51 of industry standard dishwashing rack 50, having a bottom surface 52 and a top surface 60. In the industry standard dishwashing rack 50, the plurality of drink receptacles 13 are maintained with their bottom sides 43 upward and their mouth portions 45 downward. At this point, the plurality of drink receptacles 13 are inverted and repositioned back inside the plurality of compartments 51 of industry standard dishwashing rack 50 so that their mouth portions 45 are upward and their bottom sides 43 are downward. The inversion is accomplished either by manually "flipping" each of the plurality of drink receptacle 13 individually (not shown) or as in FIG. 6A, by approximating an empty industry standard dishwashing rack 100, identical in all respects to industry standard dishwashing rack 50, on top of the industry standard dishwashing rack 50 so that the top surface 60 and plurality of compartments 51 of industry standard dishwashing rack 50 aligns with the top surface 60 and plurality of compartment 51 of industry standard dishwashing rack 100 in a reciprocal manner (FIG. 6B). The user then places one hand on the bottom surface 52 (now top) of industry standard dishwashing rack 100 and the other hand on the bottom surface 52 of industry standard dishwashing rack 50. The user then "flips" the entire arrangement: industry standard dishwashing racks 50 and 100 and the plurality of drink receptacles 13, upside-down so that the industry standard dishwashing rack 100 is on the bottom and the industry standard dishwashing rack 50 is on the top. The plurality of drink receptacles that were upside-down in the plurality of compartments 51 of industry standard dishwashing rack 50 have descended and have been inverted by the "flipping" procedure and are situated mouth portions 45 upward in the plurality of compartments 51 of industry standard dishwashing rack 100. Industry standard dishwashing rack 50, now empty of the plurality of drink receptacles 13 is removed from the top surface 60 of industry standard dishwashing rack 100 (FIG. 6C).

The ice distribution tray 12 is now placed upon the industry standard dishwashing rack 100 and plurality of drink receptacles 13 combination (FIG. 6D). The ice distribution tray 12 will be removably supported on either the upper edges 46 of the plurality of drink receptacles 13 or the top surface 60 of the industry standard dishwashing rack 100; depending which ever of the plurality of drink receptacle's height or industry standard dishwashing rack's height is greater. Attention is now directed to where the cooperating arrangement of the plurality of apertures 27 and lip portions 35 of ice distribution tray 12, mouth portions 45 and cavities 44 of the plurality of drink receptacles 13, and plurality of compartments 51 of industry standard dishwashing rack 100 all align. It is recalled that the pre-defined pattern of the plurality of apertures 27 of ice distribution tray 12 have been pre-defined to match the plurality of compartments 51 pattern of the industry standard dishwashing racks 50 and 100.

With the ice distribution tray 12 now setting on the plurality of drink receptacles 13 industry standard dishwashing rack 100 combination (FIG. 6D), the lip portions 35 of the ice distribution tray 12, which extend less than one quarter of the way into the cavities 44 of each of the plurality of drink receptacles 13 provide the multiple functions of: (1) defining a passage for ice, fluent drinking matter, or both from the the bin plate 24 of the ice distribution tray 12 into the cavities 44 of the plurality of drink receptacles 13, (2) aligning each of the plurality of drink receptacles 13 with its each of the plurality of apertures 27 of ice distribution tray 12; and maintaining that alignment, and (3) maintaining the ice distribution tray 12 in position on top of the plurality of drink receptacles 13 during the movement and distribution of ice, or fluent drinking matter, or both upon the bin plate 24.

With the ice distribution tray now removably supported by the plurality of drink receptacles 13 industry standard dishwashing rack 100 combination, ice, or fluent drinking matter, or both is scooped, poured, or otherwise placed upon the bin plate 24 where the bin plate 24 and bevelled bin walls 29 form a bin to retain the ice, or fluent drinking matter, or both. The bevelled bin walls 29 provide for quicker, smoother movement of the ice, or fluent drinking matter, or both upon the bin plate 24. The ice, or fluent drinking matter, or both is moved about by hand (assuming proper sanitary conditions) or by a rake device (FIG. 6E) so it will fall through the plurality of apertures 27 of the ice distribution tray 12 and into the cavities 44 of the plurality of drink receptacles 13. When the plurality of drink receptacles 13 are full or filled to the desired level, the ice distribution tray 12 is picked up off the plurality of drink receptacles 13 industry standard dishwashing rack 100 combination and moved to another waiting industry standard dishwashing rack 100, loaded with a second plurality of drink receptacles 13; oriented mouth portion 45 upward, via either of the procedures described above.

I claim:

1. In Combination:

a plurality of drink receptacles, each drink receptacle having a predetermined receptacle height and comprising at least a body portion defining a drink cavity and an upper edge defining a mouth for access to said drink cavity;

an industry standard dishwashing rack, having a predetermined rack height and comprising at least a top surface, bottom surface, and segmented into a plurality of compartments, arranged in a predetermined pattern, for removably retaining said plurality of drink receptacles, each said drink receptacle of said plurality of drink receptacles being removably retained by said industry standard dishwashing rack with said mouth oriented for vertical access to said cavity from above;

an ice distribution tray comprising at least side walls, a bin plate having an upper surface and a lower surface, and a plurality of apertures defined through said bin plate in a pre-defined pattern, said ice distribution tray being removably supported on either said upper edges of said plurality of drink receptacles or said top surface of said industry standard dishwashing rack, dependant on whichever of said plurality of drink receptacles' height or said industry standard dishwashing rack's height is greater;

wherein said upper edges of said plurality of drink receptacles or said top surface of said industry standard dishwashing rack engages said lower surface of said bin plate of said ice distribution tray, dependant on which ever of said plurality of drink receptacles' height or said industry standard dishwashing racks's height is greater, and wherein each said mouth of said plurality of drink receptacles is in alignment with one of said plurality of apertures such that a passage is defined from said upper surface of said bin plate through said plurality of apertures and into said cavities of said plurality of drink receptacles; and alignment means for maintaining each mouth of said plurality of drink receptacles in alignment with each aperture of said plurality of the apertures of said ice distribution tray, whereby ice, or fluent drinking matter, or both is distributed to said plurality of drink receptacles by scooping, pouring, or otherwise placing said ice, or fluent drinking matter, or both upon said upper surface of said bin plate and moving the ice, or fluent drinking matter, or both about as it falls through said plurality of apertures and into said cavities of said plurality of drink receptacles.

2. Combination of claim 1, wherein said upper edges of said plurality of drink receptacles are substantially circular;

wherein said plurality of apertures of said ice distribution tray are substantially circular; and wherein said alignment comprises at least a lip member associated with each said aperture of said plurality of apertures of said ice distribution tray, each said lip member defining an annular rim protruding from said lower surface of said bin plate and extending through said mouths and into said cavities of said plurality of drink receptacles.

3. Combination of claim 2, wherein said annular rim of each said lip member of said ice distribution tray extends less than one-quarter of the way into said cavities from said top edges of said plurality of drink receptacles.

4. Combination of claim 2, further comprising:

A second plurality of drink receptacles, identical in all respects to said first plurality of drink receptacles. Each second receptacle of said second plurality of drink receptacles comprising at least a body portion defining a drink cavity and an upper edge defining a mouth oriented for vertical access to said cavity from above; and A second industry standard dishwashing rack, identical in all respects to the said first industry standard dishwashing rack, for removably retaining said second plurality of drink receptacles therein, each said drink receptacle of said second plurality of drink receptacles being removably retained by said second industry standard dishwashing rack with said mouth oriented for vertical access from above;

wherein said ice distribution tray is movable by hand by one human user from a position removably supported on either said upper edges of said first plurality of drink receptacles or said upper surface of said first industry standard dishwashing rack, dependent on whichever of said first plurality of drink receptacles' height or first industry standard dishwashing rack's height is greater, to a position removably supported on either said upper edges of said second plurality of drink receptacles or said upper surface of said second industry standard dishwashing rack, dependant on whichever of said second plurality of drink receptacles' height or second industry standard dishwashing rack's height is greater.

5. Combination of claim 1, wherein said plurality of drink receptacles is removably retained by said industry standard dishwashing rack in a pre-defined pattern which is similar to said pre-defined pattern of said plurality of apertures of said ice distribution tray.

6. Combination of claim 5, wherein said pre-defined pattern of said plurality of apertures is defined by said plurality of apertures being aligned in a plurality of parallel rows in the first direction and also being aligned by a plurality of rows in a second direction which said second direction is perpendicular to said first direction.

7. Combination of claim 6, wherein said bin plate of said ice distribution tray is generally rectangular.

8. Combination of claim 1, wherein said pre-defined pattern of said plurality of apertures is defined by said plurality of apertures being aligned in a plurality of parallel rows in a first direction and also being aligned in a plurality of parallel rows in a second direction; said second direction is perpendicular to said first direction.

9. Combination of claim 8, wherein said bin plate of said ice distribution tray is generally rectangular.

10. Combination of claim 1, wherein the number of drink receptacles in said plurality of drink receptacles removably retained by said industry standard dishwashing rack is the same as the number of apertures in said plurality of apertures defined through said bin plate of said ice distribution tray.

11. Combination of claim 1, further comprising a hand held rake device for moving ice, or fluent drinking matter, or both about on said upper surface of said bin plate of said ice distribution tray.

12. Combination of claim 1, wherein said ice distribution tray further comprises at least a bevelled bin wall slanting from said side walls, inward and downward, to said upper surface of said bin plate.

* * * * *